US007188670B2

(12) United States Patent
Amies et al.

(10) Patent No.: US 7,188,670 B2
(45) Date of Patent: Mar. 13, 2007

(54) PLUNGER LIFT SYSTEM

(75) Inventors: Ryan Amies, Edmonton (CA); Grant George, Edmonton (CA)

(73) Assignee: Stellarton Technologies Inc.

( * ) Notice: Subject to any disclaimer, the term of this patent is extended or adjusted under 35 U.S.C. 154(b) by 0 days.

(21) Appl. No.: 11/162,805

(22) Filed: Sep. 23, 2005

(65) Prior Publication Data

US 2006/0065390 A1 Mar. 30, 2006

Related U.S. Application Data

(60) Provisional application No. 60/612,516, filed on Sep. 24, 2004.

(51) Int. Cl.
*F04B 47/12* (2006.01)
*E21B 43/00* (2006.01)

(52) U.S. Cl. ..... 166/105; 166/68.5; 417/56; 417/58

(58) Field of Classification Search ..... 166/105, 166/68.5; 417/56–60, 511, 555.2
See application file for complete search history.

(56) References Cited

U.S. PATENT DOCUMENTS

| | | | | |
|---|---|---|---|---|
| 3,020,852 | A | 2/1962 | Roach et al. | 103/225 |
| 4,813,485 | A * | 3/1989 | Coyle | 166/372 |
| 4,923,372 | A | 5/1990 | Ferguson et al. | 417/53 |
| 5,253,713 | A | 10/1993 | Gregg et al. | 166/372 |
| 5,427,504 | A | 6/1995 | Dinning et al. | 417/59 |
| 6,045,335 | A | 4/2000 | Dinning | 417/59 |
| 6,554,580 | B1 | 4/2003 | Mayfield et al. | 417/56 |
| 6,644,399 | B2 | 11/2003 | Abbott et al. | 166/68 |
| 6,725,916 | B2 | 4/2004 | Gray et al. | 166/68.5 |
| 6,915,856 | B2 | 7/2005 | Gentry et al. | 165/382 |
| 2003/0215337 | A1 | 11/2003 | Lee | 417/56 |

* cited by examiner

*Primary Examiner*—David Bagnell
*Assistant Examiner*—Giovanna M. Collins
(74) *Attorney, Agent, or Firm*—Bennett Jones LLP

(57) ABSTRACT

An intermittent lift plunger includes at least one seal mandrel, a bottom sub and an upper valve assembly. The valve assembly is closed by a well bottom stop which inserts into the lift plunger and opened by a lubricator stop at the top of the well. The seal mandrel includes a sleeve seal formed from an elastomeric rubber or plastic, which inflates to engage the well bore surface when the valve is closed and a pressure differential exists.

9 Claims, 5 Drawing Sheets

PLUNGER LIFT SYSTEM

CROSS REFERENCE TO RELATED APPLICATIONS

This application claims the priority benefit of U.S. Provisional Application No. 60/612,516 filed on Sep. 24, 2004 entitled "Well Pump", the contents of which are incorporated herein by reference.

FIELD OF THE INVENTION

The present invention relates to a plunger lift system for intermittently lifting well fluids in an oil and gas well to the surface.

BACKGROUND OF THE INVENTION

Conventional pump systems for delivery of a fluid from a well bore include pump jacks or positive cavity pumps. While these pump systems have achieved extensive use, they suffer from many disadvantages. One disadvantage is that these systems are expensive. This is particularly problematic for wells with low delivery rates as the cost of the equipment may be difficult to justify. Further, these systems require the use of external power or fuel, which requires the delivery of power or fuel to the well site. Again, the cost of providing power to a well having low delivery rate may be difficult to justify, particularly in remote well locations.

Differential gas pressure operated pistons, also known as plungers, have been used in producing subterranean wells where the natural well pressure is insufficient to produce a free flow of gas, and especially liquids, to the well surface. A completed well typically includes tubulars placed inside the well conduit, which extend from the reservoir of the well to the surface. The cylindrical plunger typically travels within the tubulars between the bottom well stop and the top of the tubulars, where a well valve and a lubricator are positioned. A spring is typically included inside the lubricator assembly to absorb the impact energy of the plunger when it reaches the surface. The well is shut in for a selected time period which allows downhole pressure to build up, then the well is opened for a selected period of time. When the well valve is opened, the plunger is able to move up the tubulars, pushing a liquid slug to the well surface. When the well valve is later closed, the plunger, aided by gravity, falls downwardly to the bottom of the tubulars. Typically, the open and closed times for the well valve are managed by a programmable electronic controller.

When the plunger is functioning properly, fluids accumulate and stay above the plunger and pressurized gases and/or fluids below the plunger are blocked from flowing up, around, and through the plunger. As a result, the plunger and accumulated fluids are pushed upwardly. The prior art devices use a variety of external, and sometimes internal, sealing elements which allow the plungers to block the upward flow of gases and to slidingly and sealably engage the tubulars, which accomplishes the lifting of fluids to the surface depending upon the variable well pressures.

Improvements of this technology may permit economic operation of wells which were previously uneconomic. Therefore, there is a continuing need in the art for improved plunger systems which obviate or mitigate disadvantages in the prior art.

SUMMARY OF THE INVENTION

The present invention comprises a plunger for intermittently lifting fluids from a well having a bottom well stop means. The plunger has an upper end and a lower end and defines an internal chamber, and comprises:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings;

(c) a valve assembly disposed at the upper end of the plunger, above the seal mandrel, comprising a valve body defining a valve opening, a valve stem and valve slidingly disposed within the valve body, which valve is moveable between a first position wherein the valve opening is closed and a second position wherein the valve opening is open; and (d) wherein the valve stem is actuated by the well stop means inserting into the plunger internal chamber.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

Figure 1:
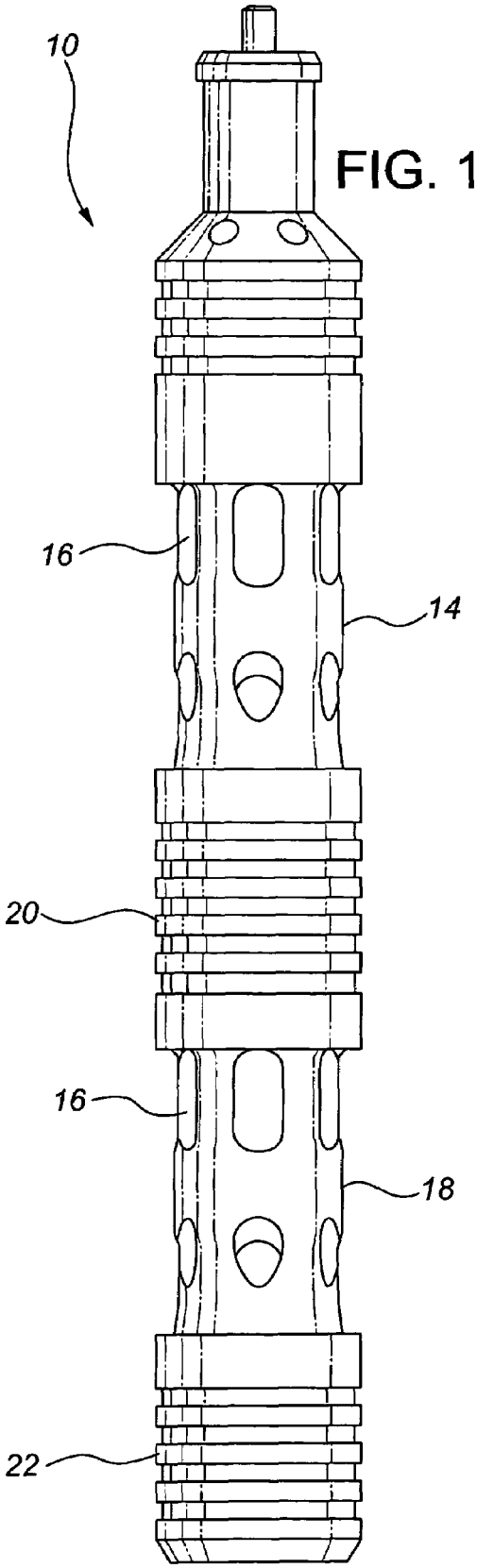
FIG. 1 is a side view of one embodiment of the present invention, without the seal sleeves in place.
Figure 2:
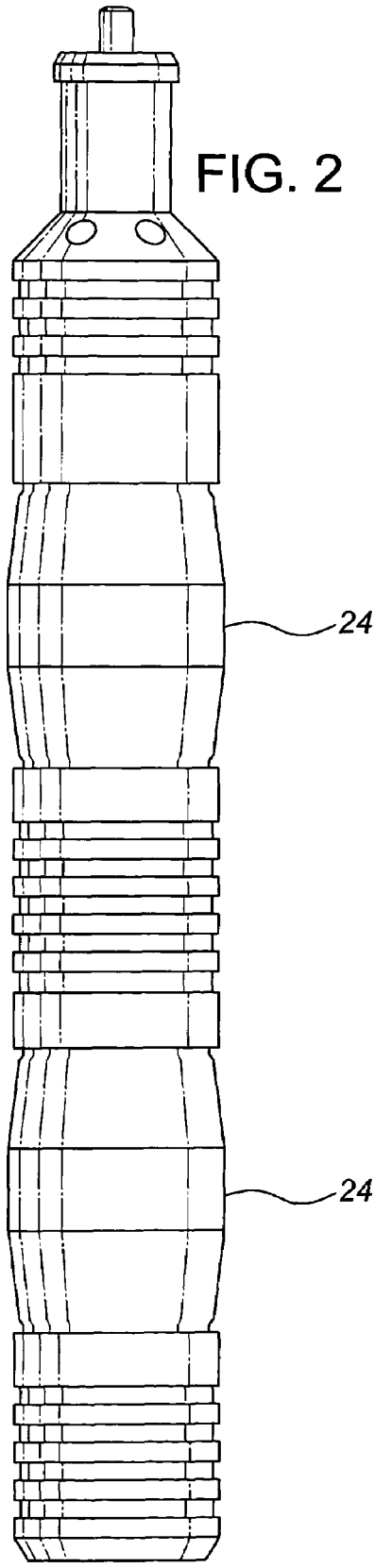
FIG. 2 is a side view of one embodiment with the seal sleeves in place.
Figure 3:
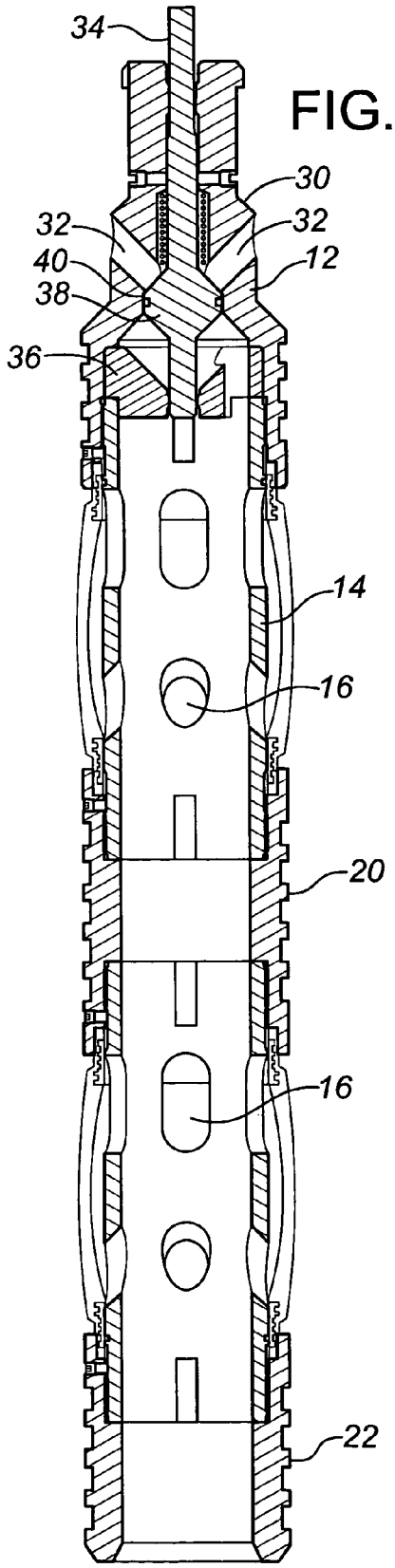
FIG. 3 is a longitudinal cross-sectional view of FIG. 2.

The present invention provides for an intermittent plunger. When describing the present invention, all terms not defined herein have their common art-recognized meanings. The plunger (10) will be described with regard to its orientation in use, such that cylindrical plunger is substantially vertical. Therefore, the terms "lateral", "radial" or "horizontal" shall refer to a direction or plane substantially perpendicular to the longitudinal vertical axis of the plunger (10).

The plunger (10) shown in the Figures is of the general type of plungers operated by differential gas pressure, as is well known in the art. In one embodiment, the plunger (10) defines a central and elongate internal chamber and includes a valve assembly (12), a first seal mandrel (14) defining a plurality of seal openings (16), a second seal mandrel (18) also defining a plurality of seal openings, and a coupler (20) for joining the two seal mandrels together. A bottom sub (22)

is attached to the lower end of the second seal mandrel (18). The various components of the plunger (10) are threadingly engaged as is well known in the art.

The seal mandrels (14, 18) each include a resilient seal (24) which covers the seal openings (16). In a preferred embodiment, the seal (24) is a sleeve made of an elastomeric material such as natural or synthetic rubber, or an elastomeric polymer. As will be apparent to those skilled in the art, if the valve assembly (12) is closed, a pressure differential between the internal chamber of the plunger and the exterior will cause the seals (24) to expand outwards. When the pressure equalizes, the seals will retract. The pressure differential required to inflate the seals is less than the pressure required to lift the plunger up the well bore.

The valve assembly (12) comprises a valve body (30) having a plurality of valve openings (32) which radiate outwards at an inclined angle from a central fluid passageway. A valve stem (34) having an integral valve (38) is supported laterally by a valve retainer (36) at its lower end, and by the valve body (30) at its upper end. The valve stem (34) protrudes into the internal chamber when the valve stem is in a lowered position, where the valve is open. When the valve stem is raised, the valve itself (38) rests against the valve seat (40) to close the valve openings.

Figure 5B:
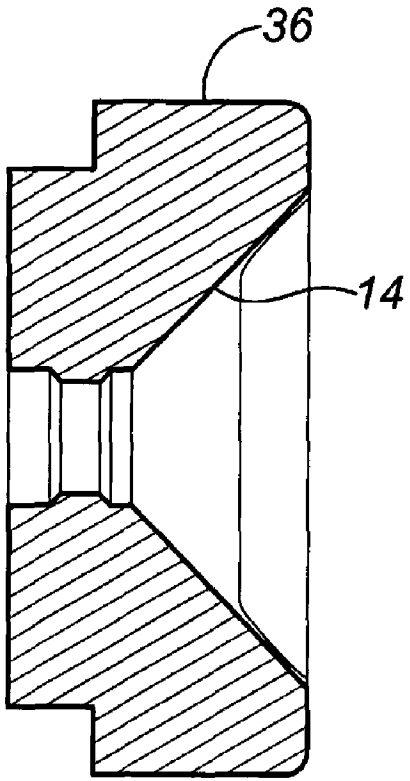
FIG. 5B is a cross-sectional view of FIG. 5A along line 5B.
Figure 5A:
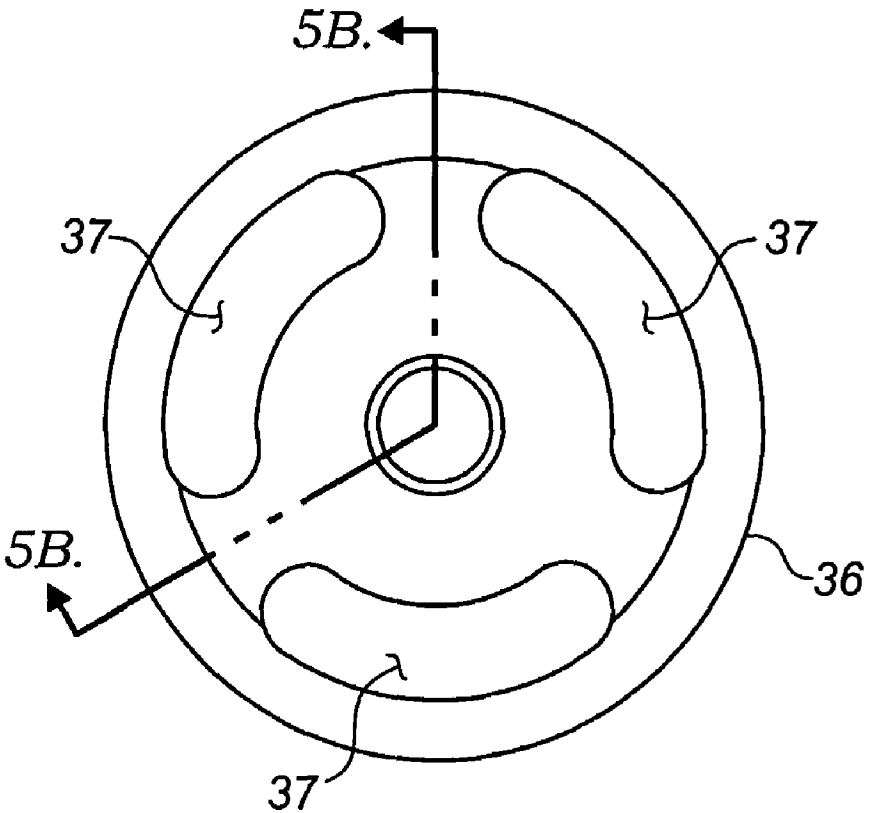
FIG. 5A is a bottom view of the valve retainer of one embodiment of the invention.

The valve retainer (36), as shown in FIGS. 5A and 5B, centralizes the valve stem (34) within the valve body (30). The valve retainer (36) defines a cone-shaped valve seat (41) which receives the lower end of the valve (38), when the valve is in a lowered, open position. The valve retainer (36) further defines a plurality of openings (37) permitting fluid flow through the valve retainer (36) and around the valve (38).

Figure 6:
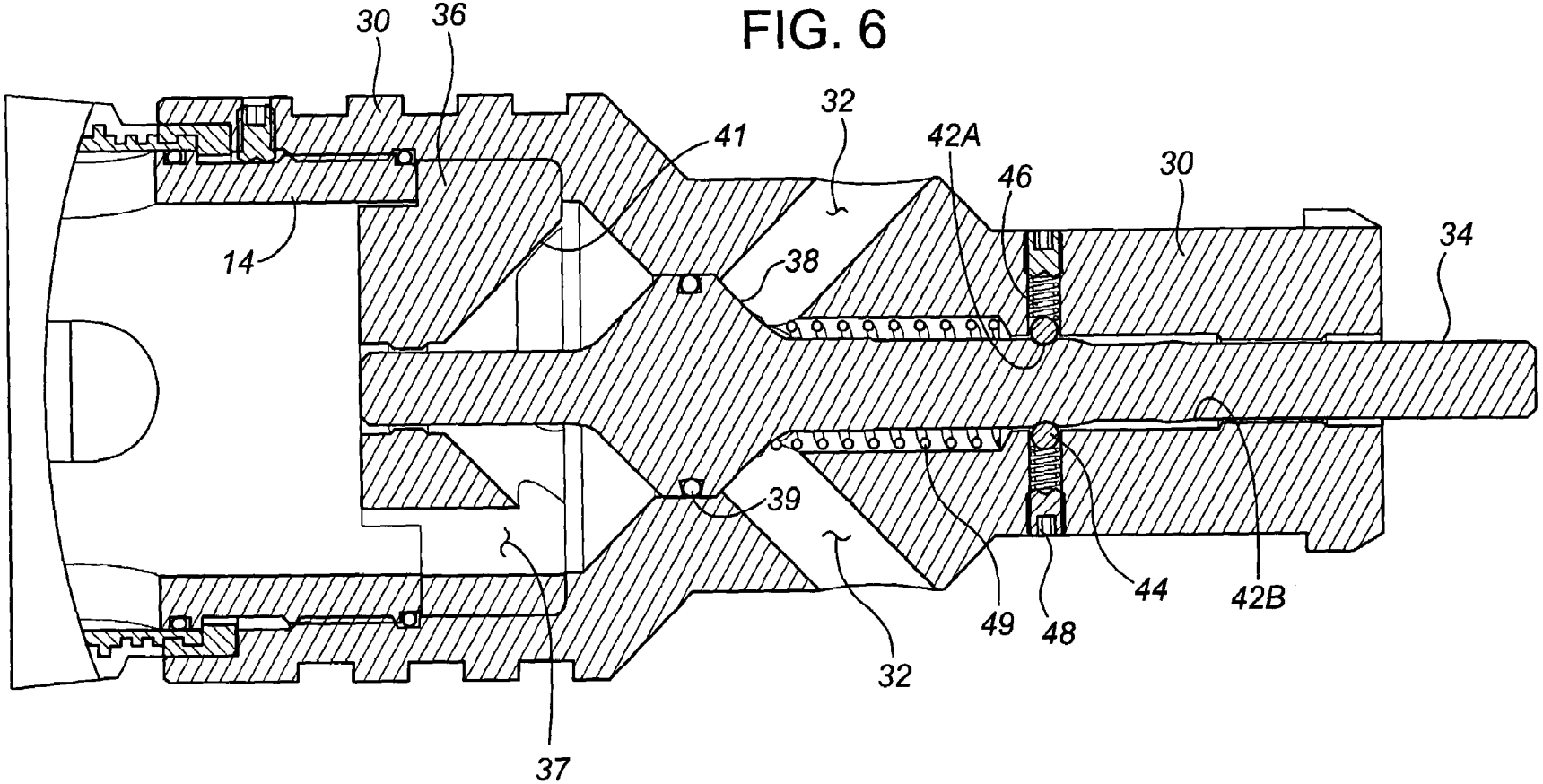
FIG. 6 is a detailed cross-sectional view of the valve assembly shown in FIG. 3, with the valve in the closed position.
Figure 7:
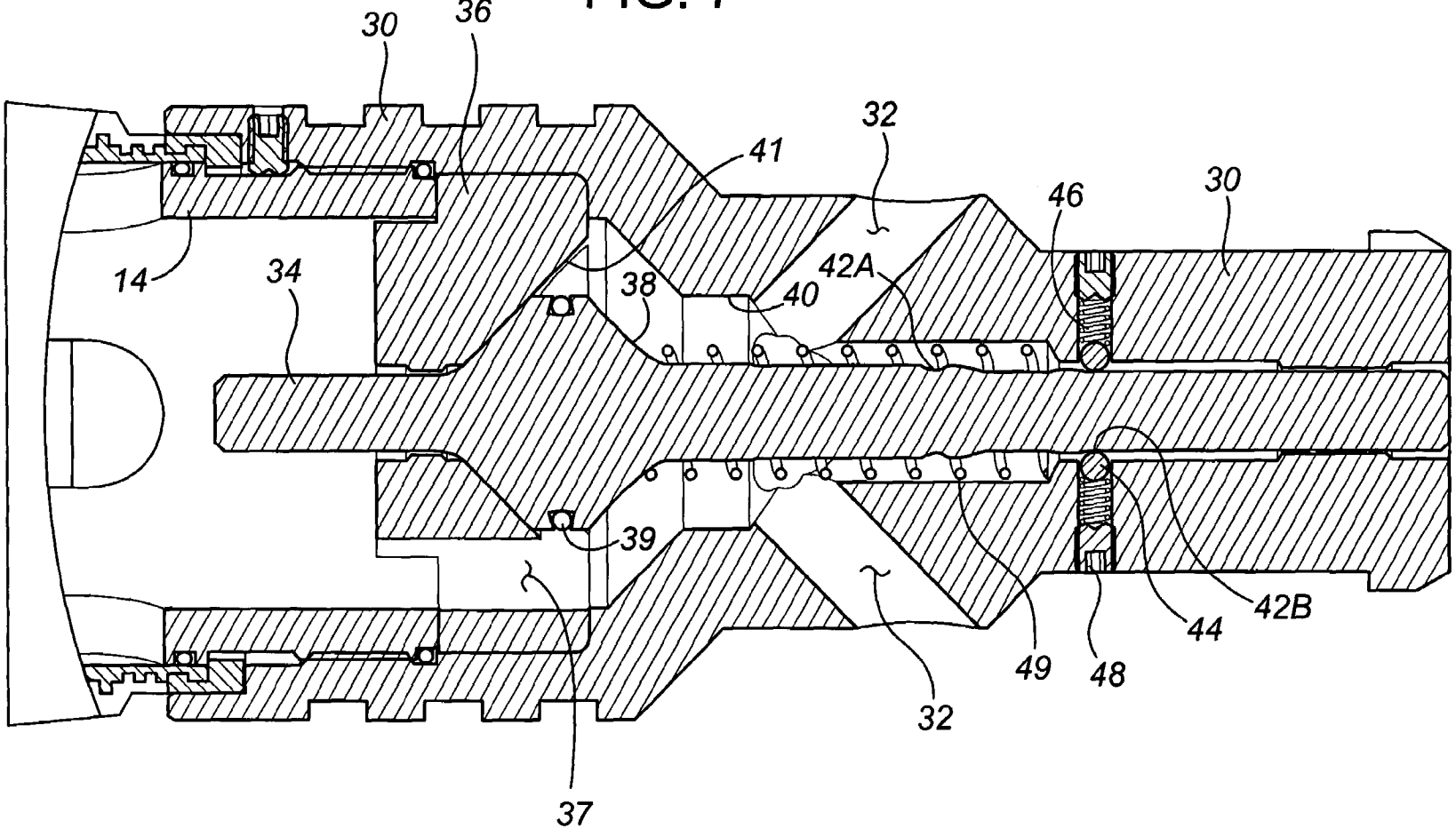
FIG. 7 is a detailed cross-sectional view of the valve assembly shown in FIG. 3, with the valve in the open position.

The valve assembly (12) is shown in more detail in FIGS. 6 and 7. The valve (38) may include an O-ring seal or a similar seal (39) which improves the seal between the valve (38) and the valve seat (40). The valve seat (40) comprises a narrowed portion of the internal passageway of the valve body (30). The space below the valve (38) is configured to allow the valve (38) to be lowered, without blocking the fluid passageways created by the valve retainer (36) and the valve body (30). Thus, when the valve (38) is lowered, the valve opens, as shown in FIG. 7.

In one embodiment, an upper portion of the valve stem (34) comprises a pair of detents (42) which cooperate with a ball detent system to maintain the valve in either the open or closed position. The ball detent system includes a ball (44) which is radially biased inwards by a spring (46) within a lateral opening in the valve body (30). The ball (44) and spring (46) are retained in the opening by a set screw (48). As shown in FIG. 6, when the valve (38) is in its closed position, the balls (44) engage the lower detent (42A), thereby maintaining the valve in the closed position. When the valve stem (38) is actuated to open the valve (38), the balls (44) are dislodged from the lower detent (42A), and engage the upper detent (42B), thereby maintaining the valve in the open position. Obviously, the force required to disengage the balls (44) from either detent cannot be greater than the force imparted to the valve stem by the well stops in operation.

In one embodiment, a valve spring (49) is provided around the valve stem (34) to bias the valve (38) towards the open position, as is shown in the Figures. The valve spring (49) diminishes the force necessary to open the valve (38) and assists in maintaining the valve in the open position during its descent in a well bore.

The exterior surface of the valve body (30) may be configured as a fish neck, to facilitate retrieval of the plunger by a fishing tool.

In operation, the plunger (10) is placed in a well bore with the valve (12) in an open position. The plunger falls down the well bore. Fluids within the internal chamber pass through the open valve. Upon reaching the well bottom, or the depth where a well stop means is positioned, the plunger contacts the well stop means, causing the valve to close. The well stop means is stationary within the well bore and includes a downhole anchor (not shown) and a valve actuating member (52) which inserts into the internal chamber and bears on the lower end (34) of the valve stem. The well stop means may have any configuration which includes a valve actuating member (52) which inserts into the internal chamber of the plunger (10). The present invention is not limited by any specific configuration of the well stop means.

Figure 4:
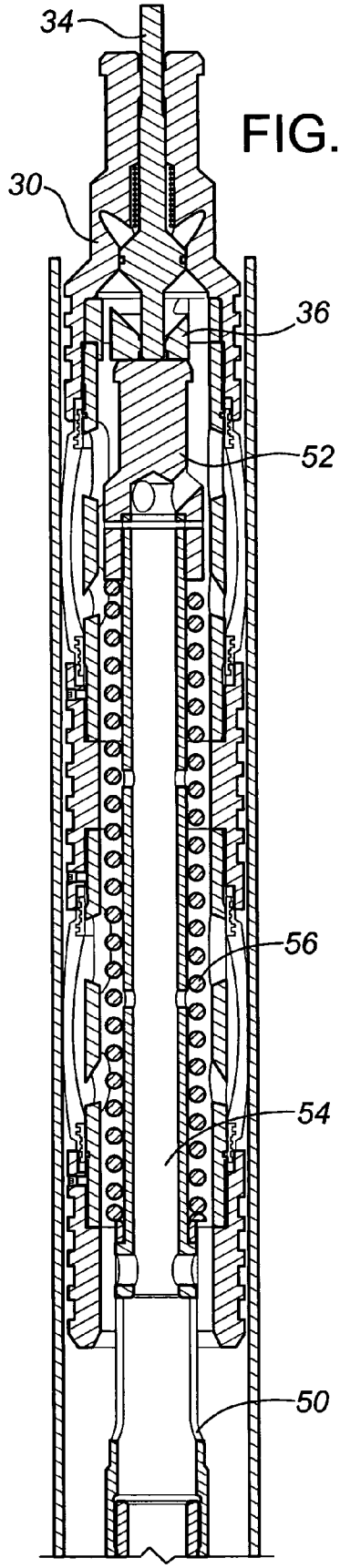
FIG. 4 is a longitudinal cross-sectional view of one embodiment of the present invention, in combination with a well bottom stop means.

In one embodiment, the well stop means may comprise a spring mounted bottomhole assembly as shown in FIG. 4. The valve actuating member (52) is mounted to a landing pin (54) by means of a spring (56), which serves to absorb the force when the plunger (10) lands on the well stop means (50). Of course, the well stop means does not form part of the plunger, but is required for its operation downhole.

Once the valve (12) closes, fluid pressure will begin to rise within the plunger internal chamber, causing the seals (24) to expand outward. Once the seals (24) expand to contact the well bore surface, fluids will not be able to rise above the plunger (10) and the rate of change of the pressure differential will accelerate. Eventually, the pressure underneath the plunger will overcome any frictional resistance of the seals against the well bore surface and the hydrostatic force of the fluid column above the plunger, and cause the plunger to rise. Any fluids above the plunger will thus be lifted to the surface.

Upon reaching the surface, a stop (not shown) actuates the upper end of the valve stem (34) and opens the valve (38), allowing the pressure differential to equalize. The seals (24) then retract to be relatively flush with the seal mandrel and the cylindrical sides of the plunger (10). The plunger then falls under the force of gravity within the wellbore, reaching the well stop means, where the lift cycle may commence again.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A plunger having an upper end and a lower end, and defining an internal chamber, for intermittently lifting fluids from a well having a bottom well stop means, said plunger comprising:

(a) at least one hollow cylindrical seal mandrel disposed between the upper end and lower end, wherein the seal mandrel defines a plurality of openings;

(b) a resilient seal sleeve attached to the seal mandrel in a fluid-tight manner, covering the seal mandrel openings;

(c) a valve assembly disposed at the upper end of the plunger, above the seal mandrel, comprising a valve body defining a valve opening, a valve stem and valve slidingly disposed within the valve body which valve is moveable between a first position wherein the valve opening is closed and a second position wherein the valve opening is open; and (d) wherein the valve stem is actuated by the well stop means inserting into the plunger internal chamber.

2. The plunger of claim 1 comprising at least two seal mandrels each having a resilient seal sleeve and joined by a coupler.

3. The plunger of claim 1 wherein the valve assembly comprises and the valve stem is centrally disposed in the valve assembly and a plurality of valve openings inclined away from vertical, radiating away from the valve stem.

4. The plunger of claim 3 wherein the valve stem partially extends into the plunger internal chamber when in its lowered position.

5. The plunger of claim 1 wherein the valve body has an exterior surface which functions as a fish neck.

6. The plunger of claim 1 wherein the valve stem is centralized by a valve retainer at a lower end of the valve stem, and by the valve body at an upper end of the valve stem.

7. The plunger of claim 6 further comprising a ball detent system within the valve body for engaging a detent formed on an upper portion of the valve stem, wherein the ball detent system comprises a ball biased in an inward radial direction by a spring, said ball cooperating with the detent to resist vertical movement of the valve stem.

8. The plunger of claim 7 comprising at least two ball detents, wherein the valve stem comprises an upper and lower detents, and wherein the upper detent engages the ball when the valve stem is in its lowered open position, and the lower detent engages the ball when the valve stem is in its raised closed position.

9. The plunger of claim 6 further comprising a valve spring for biasing the valve in an open position.

* * * * *